United States Patent [19]

Oku et al.

[11] 4,118,271

[45] Oct. 3, 1978

[54] METHOD FOR THE PREPARATION OF A PULP

[75] Inventors: Kyoichi Oku; Hiroshi Matsuura, both of Tokyo, Japan

[73] Assignee: Jujo Paper Co., Ltd., Tokyo, Japan

[21] Appl. No.: 713,120

[22] Filed: Aug. 10, 1976

[30] Foreign Application Priority Data

Mar. 25, 1972 [JP] Japan ..... 47-30184
Mar. 25, 1972 [JP] Japan ..... 47-30185

Related U.S. Application Data

[63] Continuation of Ser. No. 343,452, Mar. 21, 1976, abandoned.

[51] Int. Cl.[2] ..... D21C 11/12

[52] U.S. Cl. ..... 162/31; 162/33; 162/34; 162/89

[58] Field of Search ..... 162/29, 30 R, 30 K, 162/31, 66, 67, 89, 90, 33, 34; 55/70, 71; 423/155, 237, 240, 352, 488

[56] References Cited

U.S. PATENT DOCUMENTS

| | | | |
|---|---|---|---|
| 1,100,519 | 6/1914 | Brech et al. | 162/29 |
| 1,780,842 | 11/1930 | Richter | 162/29 |
| 1,852,264 | 4/1932 | Rinman | 162/30 |
| 2,169,473 | 8/1939 | Olsen | 162/90 |
| 3,269,095 | 8/1966 | Brannland | 55/71 |
| 3,472,731 | 10/1969 | Liebergott et al. | 162/89 |
| 3,595,742 | 7/1971 | Hess et al. | 162/30 |
| 3,622,444 | 11/1971 | Andrews | 162/89 |
| 3,652,387 | 3/1972 | Wilder | 162/89 |
| 3,694,307 | 9/1972 | Iwahashi | 162/30 |
| 3,755,068 | 8/1973 | Rapson | 162/30 |

OTHER PUBLICATIONS

Casey, "Pulp & Paper", 2nd Ed., (1960) vol. I, p. 112 498.

*Primary Examiner*—S. Leon Bashore
*Assistant Examiner*—Peter Chin
*Attorney, Agent, or Firm*—Lane, Aitken, Dunner & Ziems

[57] ABSTRACT

A process for the preparation of a pulp, involving the steps of mechanically milling a fibrous vegetable material at an elevated temperature, delignifying the milled material by reaction with a chlorine-containing compound and ammonia or ammonium hydroxide, and recovering the chlorine-containing compound from the waste liquor in the form of hydrochloric acid.

7 Claims, 3 Drawing Figures

METHOD FOR THE PREPARATION OF A PULP

This is a continuation, of application Ser. No. 343,452 filed Mar. 21, 1976 abandoned.

BACKGROUND OF THE INVENTION

This invention relates to a pulping process, and more particularly to a process for preparing a pulp from wood or other vegetable fibrous materials using a chlorine compound and ammonia which are recovered from the waste liquor in a subsequent stage.

Methods for preparing paper pulps may be broadly classified into one of three categories: (1) a mechanical method wherein pulp is produced by mechanically milling wood; (2) a chemical method wherein fibrous pulp is collected after treating the wood material with suitable chemicals to dissolve out the lignin which binds wood fibres together; and (3) a semi-chemical method wherein a gentle chemical treatment is employed in combination with a mechanical treatment. Both the chemical and semichemical methods involve a step for delignifying wood pieces which are generally called "chips" by the use of various types of cooking liquors. Such processes aim at making soluble the lignin which exists in the wood chips in a solid phase by the action of chemicals which exist in the cooking liquors in a liquid phase. Thus, the wood is delignified by a solid-liquid reaction. In this connection, it is necessary to uniformly infiltrate the cooking liquor into the chips so as to obtain a uniform and high quality pulp by a uniform delignification reaction. Moreover, in order to assure uniform infiltration of the cooking liquor into the chips, a predetermined infiltration period is required before the cooking liquor is heated to the cooking temperature at which the delignification reaction rapidly takes place. It is a common practice to provide a long infiltration period ranging from several ten minutes to several hours in industrial applications of a kraft process, a sulfite process or a semi-chemical process. Such long infiltration periods significantly lower productivity in the pulping process. It has been suggested that by using small size chips, disadvantages of such a long infiltration period can be effectively avoided. In this connection see, Nolan (TAPPI, Vol. 40 Page 170 (1957), and TAPPI, Vol. 51, Page 78 (1968), and Kleinert (TAPPI, Vol. 49, Page 53 (1963)) who experimentally confirmed the advantages of smaller size chips and proposed a rapid cooking process using fine chips. However, fibres obtained from fine chips generally suffer from mechanical damage to a greater degree, resulting in reduced pulp strengths. This has been confirmed by Hartler et al (Svensk Papperstidn 63 : 279 (1960)) through a number of investigations. Hence, it is not necessarily advantageous to employ too small a chip size for the purpose of shortening the infiltration period.

Various studies have been conducted on wood milling at elevated temperatures, including fundamental studies by Stone (TAPPI 38 : 449 and 452 (1955)), Lagergren (Svensk Papperstidn 60 : 632 and 664 (1957) and Pulp and Paper Mag. Can. October 1958, Page 217) etc. According to these studies, it has been found that (1) the energy required for milling wood is reduced when the wood is milled at high temperatures and (2) in milling wood at high temperatures, breakage of wood occurs mainly at the layers which exist between the fibres and which hold the fibres together, and therefore the breakage of the fibres per se is reduced. This is because the intermediate layers are mainly composed of lignin which becomes softer, easily yielding to breakage at higher temperatures. This phenomenon is industrially utilized, for example, in (1) the thermal crushing of wood in the production of wood fibre board, and (2) a thermal defibrating treatment in the production of high yield pulps which contain a large amount of lignin, such as a ground wood pulp, a chemi-mechanical pulp, a semi-chemical pulp, etc. Several types of industrial-sized equipment are actually in operation for the thermal defibration of fibrous plants. For example, Asplund's defibrator is well known in the art. The principle of the Asplund's defibrator and the minutes of its developing are set forth in a paper by Asplund (Svensk Papperstidn 56 : 550 (1953). Thus, it is well known that the thermal milling of vegetable fibrous material can be applied to the production of a starting material for wood fibre board and to a pulping process for obtaining a ground wood pulp, a chemi-mechanical pulp, a semi-chemical pulp, etc. However it has not been known that the treatment described above could be used as a pretreatment, i.e. refining of vegetable fibrous matter, in the preparation of the raw material for chemical pulp production. Rather, it has been generally believed that application of such a treatment would greatly reduce the strength of the resultant pulp.

The waste liquor resulting from the production of a chemical pulp has after been released into a river or sea as is. Such a practice results in a serious problem of environmental pollution due to the release of chlorine compounds, alkaline compounds, etc., which are contained in the waste liquor. Thus there exists a need to suitably treat and render the waste liquor harmless.

It is therefore an object of the invention to provide a method for the preparation of a starting material such as wood or other material for subsequent delignification by means of chlorine compounds and ammonia, and to recover useful chemical compounds from waste liquor to render the waste liquor innocous.

It is a further object of the invention to provide a method for recovering chlorine compounds and ammonia from waste liquor produced in the production of pulp.

SUMMARY OF THE INVENTION

As a result of studies on delignification of wood and other vegetable fibrous materials with chlorine compounds and ammonia, it has been discovered that when the wood or other vegetable material is milled, preferably with heating the lignin which is contained in wood and vegetable fibrous materials is softened and the fibers are easily separated at the intermediate layers to give fibres in a nearly free and sound state, allowing easy and efficient delignification. It has also been discovered that when a pulping material such as wood or vegetable fibrous materials is treated with an alkaline compound to a degree to soften the fibrous structure, prior to milling under heat, the delignification process is further improved. Furthermore, it was found that when waste liquor which is produced as a result of the delignification process is condensed and burned, ammonia contained in the waste liquor is decomposed, so that it is possible to recover the chlorine compound or compounds from the waste liquor. The ammonia may be recovered from the waste liquor by adding magnesium oxide or magnesium hydroxide to the waste liquor and treating the resultant liquor in a suitable manner.

According to the present invention, there is provided a method involving mechanical milling of a vegetable fibrous material at a temperature ranging, preferably, from 50° to 250° C., and delignifying the milled material by the use of a chlorine compound and ammonia. An alternative treating embodiment additionally involves a vegetable fibrous material so as to swell and soften the fibrous structure of the material, with an alkaline substance and then mechanically milling the material at a temperature preferably 50°–250° C., and delignifying the milled material by means of a chlorine compound and ammonia. The invention also contemplates condensing and burning a waste liquor which is secondarily produced by the delignification step to decompose ammonia contained therein, and recovering the chlorine compound from the waste liquor. Alternatively, the waste liquor may be treated by adding magnesium hydroxide to the waste liquor, recovering ammonia from the waste liquor, and then recovering the chlorine compound therefrom.

Other objects and advantages, and features of the invention will be apparent from the following detailed description taken in conjunction with the accompanying drawings, in which:

FIG. 1 is a schematic representation of the waste liquor-treating steps for recovering a chlorine compound from a waste liquor; and FIGS. 2 and 3 are schematic representations of waste liquor-treating steps for recovering ammonia and a chlorine compound together.

DESCRIPTION OF THE PREFERRED EMBODIMENTS

Figure 1:
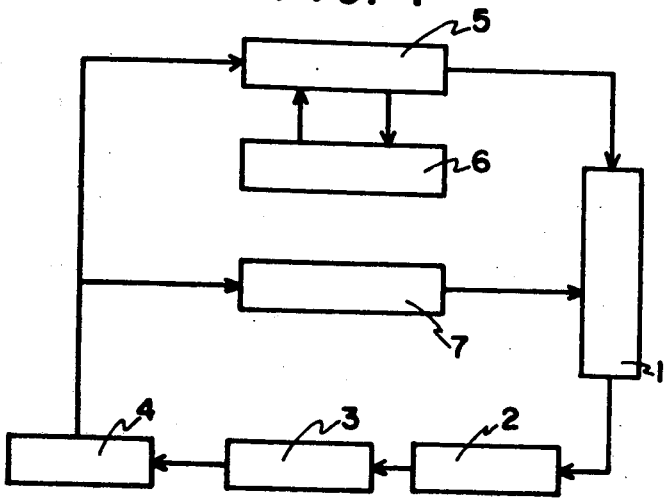

Starting materials for pulps used in the present invention may be, for example, various types of woods, bamboos, or other vegetable fibrous materials. The starting material is provided in the form of chips when wood is used, or in the form of fragments when other vegetable fibrous materials are used. The chips or pieces are heated to, preferably 50° to 250° C. by means of steam vapor, and then mechanically milled, for example, by means of a pressure type refiner while maintaining the temperature. If the milling temperature is lower than 50° C., more mechanical energy will be required for milling and hence a large amount of fines or short fibres are produced. On the contrary, if the temperature is higher than 250° C., the yield of the final pulp product is reduced. Experiments indicate that best results are obtained when the milling is carried out at a temperature ranging from 100° C. to 200° C., as is more particularly described in Examples which follow. The milling is generally conducted by the use of a pressure type refiner. Since lignin contained in the starting material is softened by the milling and heat treatment, the, lignin which exists in between the individual fibres is easily separated therefrom by the action of the refiner.

The thus milled wood or other vegetable fibrous material is then subjected to delignification by the action of a chlorine compound and ammonia, as described above, and to bleaching to produce a pulp.

The chlorine-containing agents which may be used in the present invention, include chlorine, chlorine monoxide, chlorine dioxide, hypochlorite, chlorite, chlorate, and other known chlorine substances which are used as pulping and bleaching agents. Furthermore, magnesium hydroxide may be used together with the ammonia. The magnesium hydroxide offers the advantage that it also aids at a later stage in recovering ammonia from the pulp waste liquor.

In order to more effectively carry out delignification prior to milling the starting material is treated with an alkaline compound to a degree sufficient for swelling and softening the internal structure of the starting material. That is, the chips or pieces of wood or other vegetable fibrous materials are contacted with an alkaline compound to soften the internal structure of the chip or pieces. Then, the resultant chips or pieces are milled with heat and delignified by means of a chlorine-containg compound and ammonia, as previously described. The advantages of the alkaline treatment that result from softening the chips or pieces include: (1) the milling treatment can be more effectively conducted, and (2) the hydrolysis of carbohydrates contained in the starting material is prevented by neutralizing the organic acids which are released from the starting material during the high temperature milling treatment. In other words, when the starting material is pretreated with alkaline for swelling and softening, the damage to the fiber which may occur during the milling step is reduced, thus improving the quality of the pulp. Moreover, organic acids which are generated from the starting material during milling, are neutralized by the alkaline substance, so that carbohydrates contained in the starting material are not hydrolyzed. The alkaline substances used include, for example, sodium hydroxide ($NaOH$), sodium carbonate ($Na_2CO_3$), sodium bicarbonate ($NaHCO_3$), ammonia ($NH_3$), ammonium hydroxide ($NH_4OH$), magnesium oxide ($MgO$), magnesium hydroxide ($Mg(OH)_2$) and magnesium carbonate ($MgCO_3$). These substances may be used singly or in combination. Among these, ammonia is preferred since it may be recovered in subsequent waste liquor treatment as will be described hereinafter. The amount of the alkaline compound used in the alkaline treatment preceding the milling step is not critical. It should be noted that the alkaline treatment should be as short and mild as possible since the degree of damage to fibres contained in the starting material tends to increase during the milling step due to excessive alkaline treatment. Moreover, in order to prevent hydrolysis of carbohydrates which are contained in the starting material, it is desirable to adjust the amount of alkaline compound in a manner that the pH value of the treating solution after milling is neutral to weakly alkaline.

The following describes the recovery of chlorine compounds and/or ammonia from a waste liquor resulting from the preparation of pulp. In accordance with the present invention, the chlorine compound can be advantageously recovered from a waste liquor by condensing and burning the waste liquor to decompose the ammonia contained therein. FIG. 1 illustrates the process for recovering a chlorine compound from a waste liquor. All the waste liquor exhausted from a delignifying stage and/or a bleaching stage 1 is transferred to a waste liquor condenser 2 where the liquor is condensed to a degree suitable for combustion. The condenser 2 may be any conventional type apparatus such as one employing reverse osmotic pressure, ion exchange resin, etc., or a conventional evaporator. The condensed liquor is then fed to and burned in a combustion apparatus 3. The burning apparatus may be a conventional recovery boiler, a fluidized bed reactor, a thermal cracking furnace, a wet type combustion furnace or any conventional furnace. Where a wet type combustion furnace is used as the combustion apparatus 3, the condenser 2 may be eliminated. In the combustion apparatus 3, organic substances contained in the waste liquor are burned to form carbon dioxide and water vapor, and ammonia is decomposed into nitrogen gas and water vapor. Chlorine-containing substances are converted into hydrochloric acid gas. The resultant mixed gas is then fed to a hydrochloric acid refining apparatus to collect the hydrochloric acid as a gas or a hydrochloric acid solution. Other harmless gases are released into the air. The thus collected hydrochloric acid gas or hydrochloric acid solution is then fed to a chlorine dioxide generating apparatus. The apparatus 5 is connected to a chlorate electrolyzing apparatus 6. Accordingly, sodium chlorate generated from the electrolyzing apparatus 6 is reacted with the hydrochloric acid to produce a mixed gas of $ClO_2$ and $Cl_2$ according to the following reaction $$NaClO_3 + 2HCl \rightarrow ClO_2 + \tfrac{1}{2}Cl_2 + NaCl + H_2O$$

The resultant mixed gas may be fed to the delignifying or bleaching stage 1 for re-use or may be fed to a chlorine dioxide absorbing apparatus (not shown) to collect and separate the chlorine dioxide and chlorine. A part or all of the hydrochloric acid gas or a hydrochloric solution which is recovered in the acid refining apparatus 4 may be fed to an conversion apparatus 7 for converting the same into chlorine by, for example, the Deacon method, the Shell method or the Hoechst-Uhde method. The resultant chlorine may be re-used for the preparation of a pulp, or may be recovered, as required.

Figure 2:
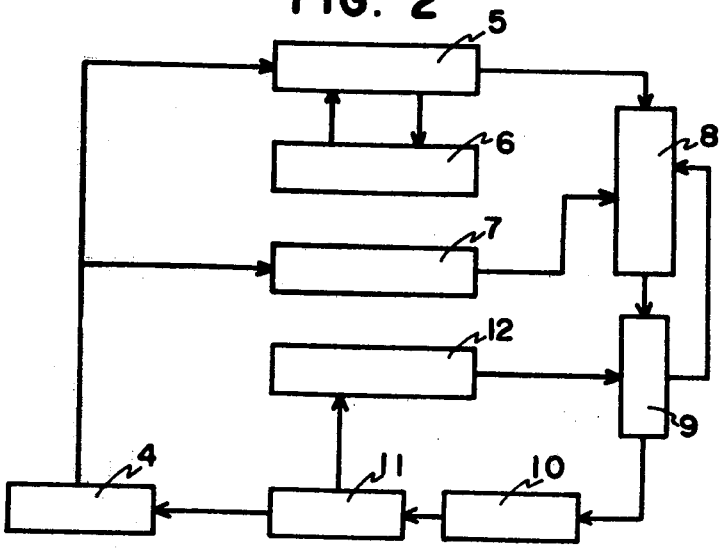

In accordance with the present invention, ammonia can also be recovered by adding magnesium hydroxide to the waste liquor, as shown in FIG. 2. All waste liquor exhausted from the delignifying stage and/or bleaching stage 8 is introduced into a steam purge apparatus 9 into which magnesium hydroxide is charged with agitation while steam vapor is introduced. Consequently, any ammonium salt in the waste liquor is converted into ammonia gas. The ammonia gas is recovered and reused by feeding the gas to the delignifying and/or bleaching stage 8. The waste liquor thus steam-purged is fed to a condensor 10 in the manner as described in connection with FIG. 1, and the condensed liquor is burned in a combustion apparatus 11. The magnesium which remains in the waste liquor after steam-purging is reacted with chlorine to form the magnesium chloride. Magnesium chloride is then burned and decomposed to form magnesia and hydrochloric acid gas. Accordingly, the hydrochloric acid gas is recovered by the combustion apparatus 11 as shown in FIG. 1. The recovered hydrochloric acid gas is purified and converted into $ClO_2$ and $Cl_2$, or $Cl_2$ alone. The magnesia formed by the combustion is hydrated by means of a slaking apparatus 12 to convert it into magnesium hydroxide. The magnesium hydroxide is introduced into the steam-purge apparatus 9 to aid in the recovery of ammonia. The ammonia is recycled through the delignifying stage and/or bleaching stage 8, the steam-purge apparatus 9, the delignifying apparatus 8. The magnesia is recycled through the slaking apparatus 12, steam-purging apparatus 9 the condenser 10 and the combustion apparatus 11 and again to the slaking apparatus 12 in that order. Magnesia for the recovery of ammonia may be used repeatedly without adding fresh magnesia without sacraficing the efficiency of the recovery of ammonia.

Figure 3:
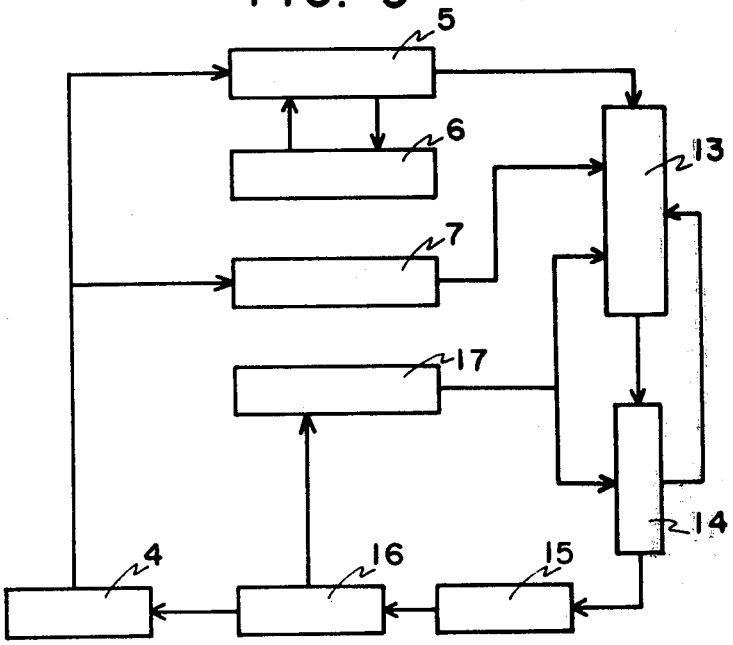

FIG. 3 illustrates another embodiment for recovering chemicals from a waste liquor wherein ammonia and magnesium hydroxide are used in the delignifying and/or bleaching stage. The waste liquor from the delignifying and/or bleaching stage 13 is introduced into a steam purge apparatus 14. Magnesium hydroxide is then mixed with the liquor while introducing steam vapor. Ammonia gas which is generated in the purge apparatus 14 is returned to the delignifying stage and/or bleaching stage. The waste liquor after being steam-purged is condensed in condenser 15 in the manner as described in connection with FIG. 2. The condensed liquor is then burned in a combustion apparatus 16 to produce magnesia. The resultant magnesia is hydrated in a slaking apparatus 17 to produce magnesium hydroxide. The magnesium hydroxide is re-used by re-circulating to both the delignifying and/or bleaching stage 13, and the steam purge apparatus 14. The hydrochloric acid gas which is recovered in the combustion apparatus 16 is treated in the same manner as described in connection with FIG. 1.

As is apparent from the foregoing, the method of the present invention offers various advantages in that a pulp can be advantageously produced by the use of relatively mild chemicals such as a chlorine compound and ammonia, and that the chemical compounds which exist in the waste liquor of the pulping process are easily recovered, so that the waste liquid contains no harmful chemicals that could cause environmental pollution.

The present invention is more particularly illustrated in the following examples. It is understood that these examples are not intended to limit the scope of the invention as defined by the appended claims.

EXAMPLE 1

Chips of Japanese beech wood were preheated by means of steam vapor to 50° C., 100° C., 150° C., 200° C. and 250° C. for 3 min., respectively and then milled by means of a pressure type refiner while maintaining the respective temperatures. For comparison, an experiment was conducted by milling similar materials at room temperature (25° C.) without steaming. The thus obtained six differently milled materials were subjected to chlorine treatment and to ammonia extraction for delignification. The treated chips were subsequently subjected to sodium hypochlorite treatment, ammonia treatment and chlorine dioxide treatment to produce bleached pulps. Treating conditions for each stage are shown in Table 1 and test results for each pulp are shown in Table 2.

Table 1

| | Chemical Charge (% by weight of wood) | Treating Temperature (° C) | Treating Time (min.) | Consistency of Starting Material (% by weight) |
|---|---|---|---|---|
| First Stage: Chlorine Treatment | 22 | 25 | 120 | 5 |
| Second Stage: Ammonia Treatment | 18 | 70 | 60 | 10 |
| Third Stage: Na-hypo Treatment* | 10 | 40 | 180 | 10 |
| Fourth Stage: Ammonia Treatment | 5 | 70 | 60 | 10 |
| Fifth Stage: Chlorine dioxide Treatment | 1.5 | 70 | 240 | 10 |

*Note: The amount added of Na-hypo is a value shown as "Available Chlorine".

Table 2

| | Sample No. | | | | | |
|---|---|---|---|---|---|---|
| | 1 | 2 | 3 | 4 | 5 | 6 |
| Chip Milling Conditions | | | | | | |
| Milling Temperature (° C) | 25 | 50 | 100 | 150 | 200 | 250 |

Table 2-continued

| | Sample No. | | | | | |
|---|---|---|---|---|---|---|
| | 1 | 2 | 3 | 4 | 5 | 6 |
| Milling Power (KWH/T of Pulp) | 460 | 440 | 405 | 310 | 280 | 265 |
| Amount of Fine Fibres** (% by weight) | 18.5 | 16.8 | 11.4 | 4.6 | 3.1 | 2.8 |
| Test Results | | | | | | |
| Bleached Pulp Yield (% by weight) | 65.3 | 65.3 | 65.2 | 64.5 | 63.2 | 62.7 |
| Freeness of Unbeaten Pulp (ml) | 270 | 340 | 505 | 680 | 680 | 700 |
| Brightness of Unbeaten Pulp (% G.E.) | 86.0 | 85.9 | 86.5 | 86.8 | 86.1 | 85.9 |
| Tear Factor*** | 79 | 84 | 96 | 110 | 107 | 110 |
| Breaking Length*** (km) | 5.7 | 6.0 | 6.7 | 7.8 | 7.6 | 7.5 |

**1. Percentage (%) through 80 mesh.

***2. Tear factor and Breaking length are determined by paper sheets formed from the pulp which has been beaten to 250 ml of CS freeness by means of a PFI mill.

As is apparent from Table 2, when the milling of the chips is conducted at higher temperatures, the power required for milling is reduced and the strength of the bleached pulp obtained is remarkably improved. The yields of the bleached pulps obtained tend to decrease to a slight degree with higher milling temperatures; however, all of the pulp yields remained higher than 60%.

EXAMPLE 2

1 kg by absolute dry weight of the same type of beech wood chips used in Example 1 was immersed for 60 min. in 10 l of a sodium hydroxide solution having a concentration of 50 g/l and heated to 60° C. At the end of the 60 min. period the chips were removed from the solution and the excess alkaline solution was removed. The chips were then heated to 130° C. by means of steam vapor and were maintained at that temperature for 3 min. The thus treated chips were milled by means of a refiner while maintaining the 130° C. temperature. The power required for the milling was 240 KWH/Ton of chip. The yield of the milled materials was 89.6% by weight of the starting chips. The milled material was subjected to chlorine treatment (wherein the amount of added chlorine was 21% by weight) and ammonia treatment (wherein the amount of ammonia was 15% by weight) for delignification. The material was then subjected to sodium hypochlorite treatment (wherein available chlorine was present in an amount of 8% by weight), sodium hydroxide treatment (wherein the amount added of sodium hydroxide was 4% by weight) and a chlorine dioxide treatment (wherein the amount of chlorine dioxide was 1.2% by weight) to produce a bleached pulp having a brightness of 86.5% G.E. with a yield of 61.8 % by weight of the starting chips. Treating conditions, other than amounts of chemicals added, were the same as used in Example 1. The resultant bleached pulp was beaten by means of a PFI mill to 400 ml of CS freeness. The thus beaten pulp was used for producing hand-made sheets. These sheets had a tear factor of 118 and a breaking length of 8.0 km. It is apparent from the test results that when the chips were pretreated with sodium hydroxide, the power required to mill the chips was reduced and the pulp quality was improved.

EXAMPLE 3

It is well known that when chlorine dioxide is used together with chlorine in the first chlorination stage for bleaching a chemical pulp, such as a kraft pulp, a reduction of pulp viscosity can be effectively prevented. The following example is presented for confirming the influence of chlorine dioxide when mixed with chlorine in the chlorine-treating stage.

The milled material of Sample No. 4 of Example 1 was used as the starting material. The material was subjected to a first stage chlorination treatment and second stage ammonia treatment for delignification. The thus treated material was further subjected to a third stage sodium hypochlorite treatment, fourth stage ammonium hydroxide treatment and, in the fifth stage, chlorine dioxide treatment. The same conditions used in Example 1 were employed except that the ratios of $Cl_2/ClO_2$ used in the first stage for chlorination were (as available chlorine): 100/0, 90/10, 70/30, 50/50, 30/70 and 0/100. The properties of the six different resultant pulps are shown in Table 3 below.

Table 3

| | Sample No. | | | | | |
|---|---|---|---|---|---|---|
| | 1 | 2 | 3 | 4 | 5 | 6 |
| At First Stage | | | | | | |
| $Cl_2/ClO_2$ Ratio | 100/0 | 90/10 | 70/30 | 50/50 | 30/70 | 0/100 |
| Test Results | | | | | | |
| Brightness (% G.E.) | 86.8 | 87.0 | 87.6 | 88.1 | 80.0 | 88.9 |
| Yield (% by weight) | 64.5 | 64.0 | 67.8 | 61.2 | 60.8 | 59.6 |
| Degree of Polymerization | 1420 | 1600 | 1690 | 1810 | 1870 | 2210 |
| Tear Factor* | 110 | 106 | 108 | 112 | 106 | 111 |
| Breaking length* (km) | 7.8 | 7.8 | 8.0 | 7.7 | 7.9 | 7.7 |

*Note: Tear Factor and Breaking Length were determined at Canadian standard freeness of 400 ml. (PFI mill)

It is apparent from Table 3 that when chlorine dioxide is mixed with chlorine in the first stage of chlorination, the brightness of the pulps is improved as well as the degree of the polymerization. As for the strengths, significant differences between pulps, treated with different mixing ratios of chlorine and chlorine dioxide, were not recognizable.

EXAMPLE 4

1 kg (oven dry weight) of beech wood chips were prepared in a manner as to have a moisture content of 50% by weight. Ammonia gas was allowed to be absorbed into the chips in the amount of 2.5% by weight based on the oven dry weight of the chips to swell the chips. Then, the chips were heated to 150° C. by means of steam vapor at which temperature they were milled by the use of a pressurized refiner. The yield of the resultant milled material reached 91.2% by weight of the oven dry chips. The milled material was subjected to a five stage treatment, i.e., a chlorine treatment —ammonia extraction, a second chlorine treatment, a second ammonia, and a second chlorine treatment, under the treating conditions shown in Table 4. As a result, bleached pulp with a brightness of 88.3% G.E. was obtained with a yield of 66.1% by weight based on the starting dried pulp.

Table 4

| | First Stage $ClO_2$ | Second Stage $NH_3$ | Third Stage $ClO_2$ | Fourth Stage $NH_3$ | Fifth Stage $ClO_2$ |
|---|---|---|---|---|---|
| Chemical Charge (% by weight/chip) | 10 | 6 | 3 | 1.5 | 1 |
| Temperature (° C) | 50 | 90 | 70 | 90 | 80 |
| Time (min.) | 60 | 10 | 180 | 10 | 180 |
| Starting Material Consistency (% by weight) | 8 | 20 | 10 | 20 | 10 |

EXAMPLE 5

All the waste liquors were collected after washing the milled material at the end of each stage in example 4.

The collected waste liquors were mixed together, and then divided into two equal portions. One portion was subjected to the following test.

One portion of the waste liquor was condensed by means of a rotary evaporator to a solids concentration of 60%. The thus condensed liquor was burned in a combustion furnace. The combustion gas generated from the furnace was passed through a cooling water reflux type condenser to condense and collect hydrochloric gas and water vapor. Analytical results revealed that 33.7g of hydrochloric acid was present in the condensed liquor. This analysis shows that about 89% by weight of the chlorine which was used in the form of chlorine dioxide in the pulping process of Example 4 was recovered. The hydrochloric acid solution was condensed by repeating stripping and condensing steps to obtain a 32% hydrochloric acid solution. This concentrated hydrochloric acid solution could be used for generation of chlorine dioxide by reaction with sodium chlorate. Thus, the present invention provides a means for recovering the chlorine-containing compounds used in the pulping process.

The ammonia present in the waste liquor was decomposed by combustion into nitrogen gas and water vapor, and therefore could not be recovered. However, these products from the decomposition of ammonia may be exhausted into the air in the harmless form, so that no problem of air pollution arises.

EXAMPLE 6

The other portion of the mixed waste liquor of Example 5 was mixed with 68g of magnesium hydroxide (which was equivalent, to the amount of ammonia used for pulping). Then, the mixture was heated by means of steam vapor to evaporate the ammonia gas. The ammonia gas was cooled, condensed and recovered as aqueous ammonia. Analytical results revealed that 36.4g of ammonia was contained in the ammonia solution. This showed that about 91% by weight of ammonia which was used for the pulping process were recovered. The residual solution was then condensed and burned in the same manner as in Example 5 to obtain 67.7g of ash. The analytical results revealed that the ash contained 97.8% by weight of MgO and a balance of $CaCl_2$. This ash was then washed with water to dissolve out the $CaCl_2$. A suitable amount of water was added to the thus washed ash while heating, to convert the MgO into magnesium hydroxide. The amount of the resultant magnesium hydroxide was 67.5g, which amount represented more than 99% by weight of the magnesium hydroxide used for the stripping of ammonia.

A hydrochloric acid solution was recovered by condensing and burning the waste liquor in the same manner as in Example 5. The analytical results revealed that the solution contained 35.2g of hydrochloric acid. This indicated that 95% by weight of the chlorine used for pulping was recovered. This hydrochloric acid solution could be used for generating chlorine dioxide in a manner similar to that described in Example 5 or could be converted in to chlorine gas by the Deacon process, Shell process, or Hoechst-Uhde process the for reuse in the pulping process.

What is claimed is:

1. A process for the preparation of pulp comprising:
   i. mechanically milling a vegetable fibrous material at 50°–250° C. to soften its tissue;
   ii. delignifying the milled material by treatment in separate stages with a chlorine-containing compound and ammonia or ammonium hydroxide thereby forming a waste water containing (a) the chlorine-containing compound and (b) ammonia, ammonium hydroxide or an ammonium salt;
   iii. separating the delignified fibrous material from said waste liquor;
   iv. adding magnesium hydroxide to said waste liquor for reaction with said chlorine-containing compound to form magnesium chloride and to release ammonia for recovery; then
   v. burning said waste liquor to decompose said magnesium chloride to hydrogen chloride and magnesium oxide;
   vi. absorbing said hydrogen chloride in an aqueous medium for conversion to hydrochloric acid;
   vii. converting said hydrochloric acid into said chlorine-containing compound; and
   viii. recirculating the ammonia and chlorine-containing compounds recovered in steps iv and vii to the delignifying step ii.

2. The process of claim 1 wherein a part of said ammonia or ammonium hydroxide is replaced with magnesium hydroxide.

3. The process of claim 1 wherein said chlorine-containing compound is selected from chlorine, chlorine monoxide, chlorine dioxide, hypochlorites, chlorites, chlorates and mixtures thereof.

4. The process of claim 1 wherein the delignifying step is repeated two or more times.

5. The process of claim 1 additionally comprising slaking the magnesium oxide to form magnesium hydroxide and recirculating the thus formed magnesium hydroxide to step iv.

6. The process of claim 1 wherein the structure of the vegetable fibrous material is softened by treatment with an alkali compound before the milling step.

7. The process of claim 1 wherein said alkali compound is selected from sodium hydroxide, sodium carbonate, sodium bicarbonate, ammonia, ammonium hydroxide, magnesium oxide, magnesium hydroxide and mixtures thereof.

* * * * *